United States Patent [19]

Ahroni

[11] 4,178,061

[45] Dec. 11, 1979

[54] FUSED ELECTRICAL PLUG

[76] Inventor: Joseph M. Ahroni, 1631 16th Ave., Apt. 413, Seattle, Wash. 98122

[21] Appl. No.: 768,771

[22] Filed: Feb. 15, 1977

[51] Int. Cl.[2] ..... H01H 85/12; H01H 85/22; H01R 13/68

[52] U.S. Cl. ..... 339/147 P; 337/196; 337/198; 337/211

[58] Field of Search ..... 337/197, 198, 201, 256, 337/263, 264, 211; 339/147 R, 147 P

[56] References Cited

U.S. PATENT DOCUMENTS

| | | | |
|---|---|---|---|
| 1,902,568 | 3/1933 | Maxam | 337/201 X |
| 1,904,691 | 4/1933 | Magee | 337/201 X |
| 2,640,125 | 5/1953 | Eggers | 337/201 X |
| 3,976,967 | 8/1976 | Magherini | 337/264 X |

FOREIGN PATENT DOCUMENTS

| | | | |
|---|---|---|---|
| 690517 | 4/1953 | United Kingdom | 337/197 |

*Primary Examiner*—E. F. Desmond
*Attorney, Agent, or Firm*—Seed, Berry, Vernon & Baynham

[57] ABSTRACT

A fused electrical plug including a plug body having a pair of forwardly projecting conductor prongs for insertion into a socket. A pair of conductors entering the plug are connected to respective conductor prongs through fuses which are removable by opening an access door on a lateral face of the plug body. A locking plate slides along the prongs of the plug and locks the access door in its closed position when the locking plate abuts the forward end of the plug body. In a first and second embodiment the access door includes an access cover extending between two parallel side walls. The inside face of the access cover contains a pair of inwardly projecting fuse holders which insert the fuses in their proper position inside the fuse body when the access door is closed. In the first embodiment the access door pivots away from the plug body about a transverse edge of the access cover, while in a second embodiment the access door slides away from the plug body in a lateral direction. In the first and second embodiments a pair of retaining fingers project rearwardly from opposite sides of the locking plate. The retaining fingers are inserted in respective slots in the side walls of the access door to lock the door in its closed position when the locking plate abuts the front face of the plug body. In a third embodiment the access door includes an access cover which is slidably secured to the plug body. The access cover is opened by sliding it forwardly along the lateral face of the plug body. When the locking plate abuts the front face of the plug body, the front edge of the access cover contacts the locking plate thereby locking the access door in its closed position.

38 Claims, 12 Drawing Figures

FIG. 4
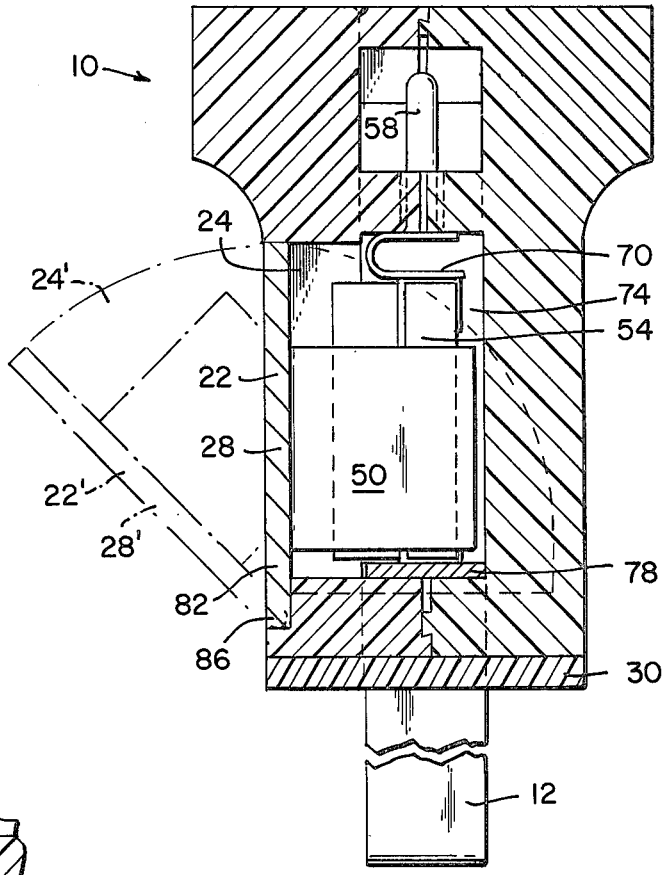
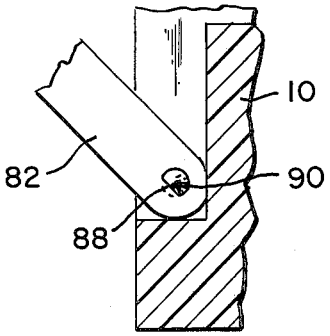
FIG. 5
FIG. 6
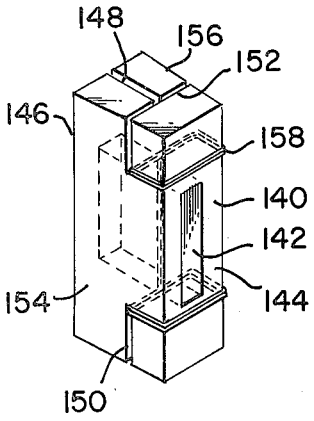
FIG. 7
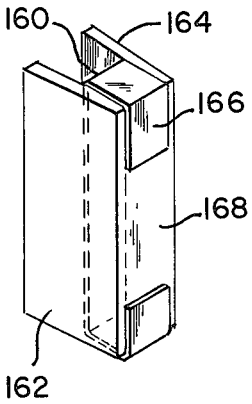
FIG. 8
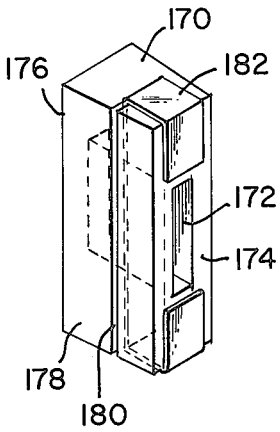
FIG. 9
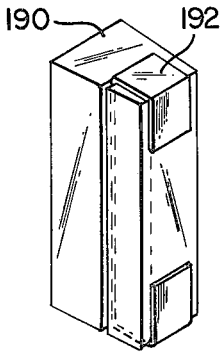

FUSED ELECTRICAL PLUG

BACKGROUND OF THE INVENTION

1. Field of the Invention

This invention relates to electrical plugs having internal fuses and, more particularly, a fused electrical plug having an easily opened cover to allow access to the fuses, and means for locking the cover in a closed position when the plug is inserted into a socket.

2. Description of the Prior Art

Electrical plugs having internal fuses for opening an electrical circuit responsive to excess current flow are well known and in common use. The principal disadvantage of such plugs is that the fuses are extremely inaccessible and hence difficult to replace after one of the fuses has opened responsive to a short circuit. Often the plug must be entirely disassembled, a procedure which at best takes a substantial period of time. Reassembly of plugs of only moderate complexity often exceeds the abilities of individuals having only average mechanical aptitudes so that the plugs may be assembled incorrectly, possibly resulting in a dangerous condition. Consequently, it is desirable that the fuses be easily accessible so that they can be quickly changed by individuals possessing only moderate mechanical aptitudes. Another problem with conventional plugs having internal fuses is that there is no means for readily determining which, if any, of two fuses has blown. Consequently, it is often necessary to disassemble the plug simply to determine if any of the fuses must be replaced.

One potential problem encountered in designing a plug structure for making the fuses readily accessible is that the fuses may become too easily accessible when the conducting prongs of the plug are inserted in a socket. Under such conditions, it is very possible for a user to contact one of the electrical conductors normally abutting the fuse and receive a potentially serious shock.

SUMMARY OF THE INVENTION

It is an object of the invention to provide an electrical plug having an internal fuse which can easily and quickly be replaced without disassembly of the plug.

It is another object of the invention to provide a safety mechanism for an electrical plug having a readily accessible fuse so that the fuse is virtually inaccessible when the prongs of the plug have been inserted into a socket.

It is still another object of the invention to provide a structure which allows an individual to visually determine which, if any, fuses have been opened.

It is a further object of the invention to provide a fusable electrical plug of the characteristics described which can be inexpensively manufactured.

These and other objects of the invention are provided by an electrical plug having a pair of internal fuses which are removable through an access door on one side of the plug body. A locking plate having a pair of slots for receiving the conductor prongs of the plug maintains the access door in its closed position when the locking plate abuts the plug body. Insertion of the prongs into a wall socket maintains the locking plate in contact with the plug body thereby locking the access door in its closed position. The access door may be transparent allowing visual inspection of the fuses to determine which, if any, fuses have been opened. The access door may be opened by lateral movement away from the plug body in which case it is retained in its closed position by a pair of retaining fingers projecting into respective slots in the door. Alternatively, the access door may be opened by longitudinally sliding the door along the fuse body so that when the locking plate is moved rearwardly so that it abuts the plug body it contacts the forward edge of the access door to prevent it from sliding along the plug body thereby locking the door in its closed position.

BRIEF DESCRIPTION OF THE DRAWINGS

FIG. 4 is a cross-sectional view of the fused electrical plug taken along the line 4—4 of FIG. 3.

FIG. 5 is a detail view of the access door hinge illustrated in FIG. 4.

FIGS. 6–9 are isometric views of various embodiments of the fuses utilized in the inventive fused plug.

DETAILED DESCRIPTION OF THE INVENTION

Figure 1:
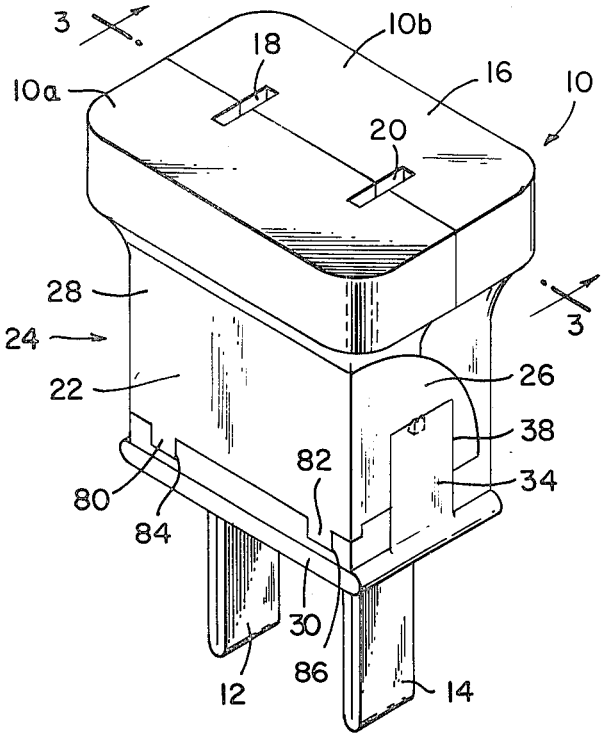
FIG. 1 is an isometric view of a first embodiment of the fused electrical plug having its access door in a closed position.

The external details of a first embodiment of the fused electrical plug as illustrated in FIG. 1 includes a plug body 10 having a pair of forwardly projecting conducting prongs 12,14. The rear face 16 of the plug body 10 may include a pair of add-on plug slots 18,20 which are adapted to receive the prongs (not shown) of a second plug thereby connecting the prongs of the second plug to the prongs 12,14 of the fused plug. It will be understood, however, that it is not necessary for the fused plug of the first embodiment, as well as the second and third embodiments, to be capable of receiving an add-on plug.

An access door 22 covers one lateral face of the plug body 10. The access door 22 includes a pair of said walls 24,26 secured to opposite sides of an access cover 28.

The front face of the plug body 10 is covered by a locking plate 30 which slips over the prongs 12,14 until the rear face of the locking plate abuts the front face of the plug body 10. A pair of retaining fingers 32 (not shown in FIG. 1), 34 fit into respective slots 36 (not shown in FIG. 1), 38. The plug body 10 is preferably fabricated in two sections 10*a,b*. The internal components described hereinafter are then assembled in each of the sections 10*a,b* and the two sections are then joined together. Although the two sections 10*a,b* can be secured to each other by any suitable technique such as gluing, the sections are preferably joined by providing interlocking edges on the two sections such as the beveled interlocks illustrated in FIGS. 4 and 12.

Figure 2:
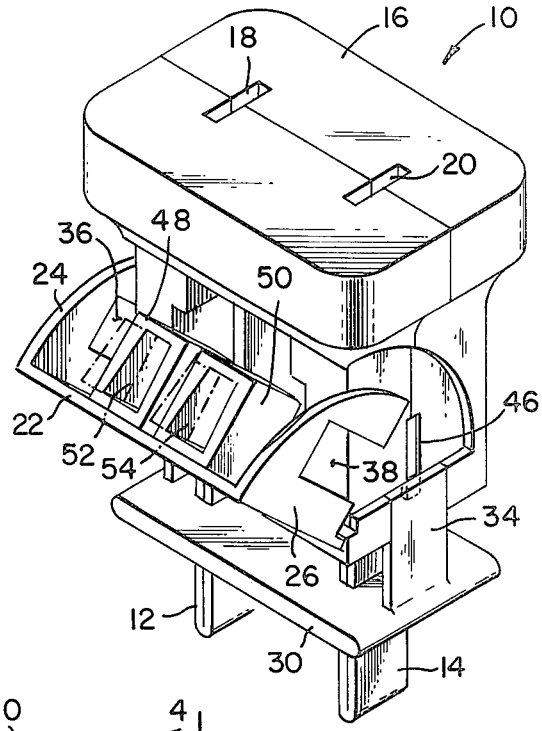
FIG. 2 is an isometric view of the fused electrical plug of FIG. 1 showing the access door in its open position.

The access door 22 is opened as illustrated in FIG. 2 by sliding the locking plate 30 forwardly thereby removing the retaining fingers 32,34 from the slots 36,38, respectively. The ends of the retaining fingers 32,34 include inwardly projecting tabs 40,42, respectively which fit into elongated slots 46. The tabs 40,42 restrict the forward movement of the locking plate 30 to prevent removal of the locking plate 30 from the prongs 12,14.

A pair of fuse holders 48,50 project inwardly from the inside face of the access cover 28. The fuse holders 48,50 contain a rectangular or tapered bore into which fuses 52,54 are inserted. If desired, a tab may project inwardly from one end of the fuse holders 48,50 to abut one end of the fuses 52,54 and restrict axial movement thereof. As explained hereinafter, the fuses 52,54 are automatically inserted in their proper positions within the plug body 10 by closing the access door 22. The locking plate 30 is then moved rearwardly so that the retaining fingers 32,34 are inserted in the slots 34,36, respectively, as illustrated in FIG. 1, thereby locking the access door 22 in its closed position. It is important to note that as long as the conducting prongs 12,14 are inserted in a socket it is impossible to move the locking plate 30 forwardly. Consequently the access door 22 is locked in its closed position as long as the prongs 12,14 are inserted in a socket.

Figure 3:
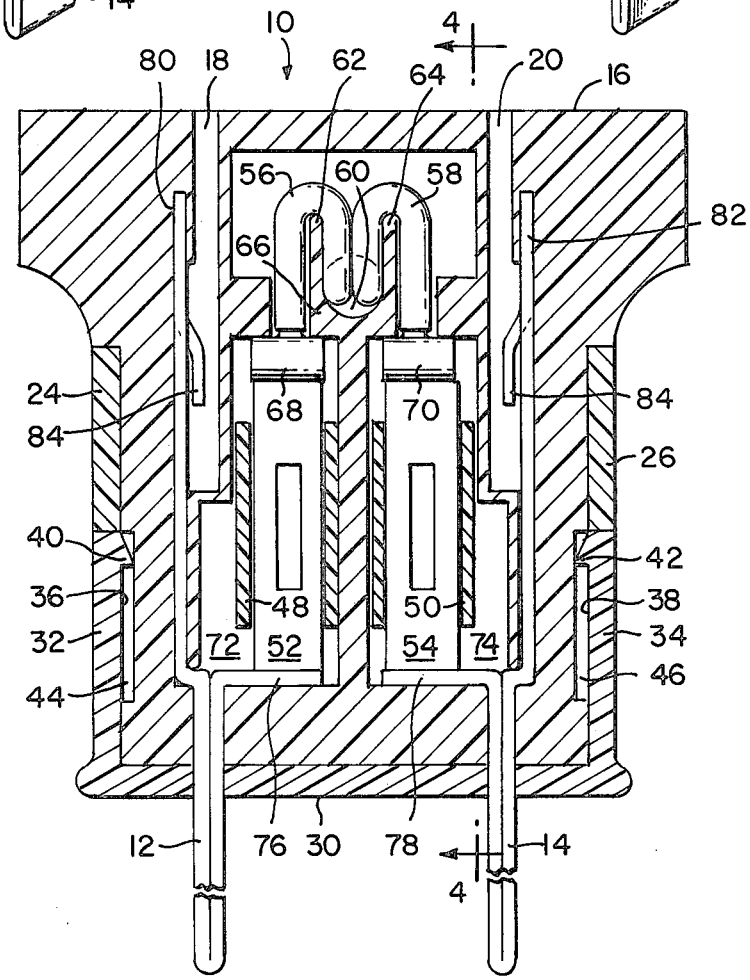
FIG. 3 is a cross-sectional view of the fused electrical plug taken along the line 3—3 of FIG. 1.

The internal components of the fusable electrical plug are best illustrated in FIGS. 3 and 4. A pair of electrical conductors 56,58 enter the plug body 10 through an aperture 60 and pass above rearwardly extending legs 62,64, respectively of a generally U-shaped ridge 66 which straddles the aperture 60. The conductors 56,58 then extend downwardly and terminate in U-shaped, resilient contacts 68,70, respectively, at one end of fuse recesses 72,74, respectively. The U-shaped ridge 66 exerts a great deal of frictional restraining force on the conductors 56,58 to secure the conductors 56,58 inside the plug body 10. The rearward portions of the conductor prongs 12,14 include a pair of contact plates 76,78, respectively extending toward each other, and rearwardly extending add-on plug contacts 80,82, respectively including resilient tabs 84 adapted to contact the prongs of an add-on plug (not shown) inserted through the add-on plug slots 18,20.

As best illustrated in FIG. 4, movement of the access door 22 from its open position 22' to its closed position 22 automatically inserts the fuse 54 in the fuse recess 74 so that the upper end of the fuse 54 abuts the lower leg of the U-shaped contact 70. The contact 70 is formed of a resilient conductive material and, since the curved portion of the contact 70 faces the direction from which the fuse 54 is inserted, insertion of the fuse 54 moves the lower leg of the contact 70 upwardly so that the contact 70 is resiliently biased against the upper end of the fuse 54.

With further reference to FIGS. 1 and 5, the forward transverse edge of the access cover 28 includes a pair of forwardly projecting hinge members 80,82 which are received in slots 84,86, respectively in the plug body 10. A through bore 88 formed in the hinge member 82 receives a pin 90 extending into the notch 86 so that the hinge member 82 pivots about the pin 90. As best illustrated in FIG. 5, a portion of the curved end of the hinge member 82 is trimmed so that opening of the access door 22 cams the ends of the hinge members 80,82 against the plug body 10 to limit the pivoting movement of the access door 22 away from the plug body 10.

Figure 10:
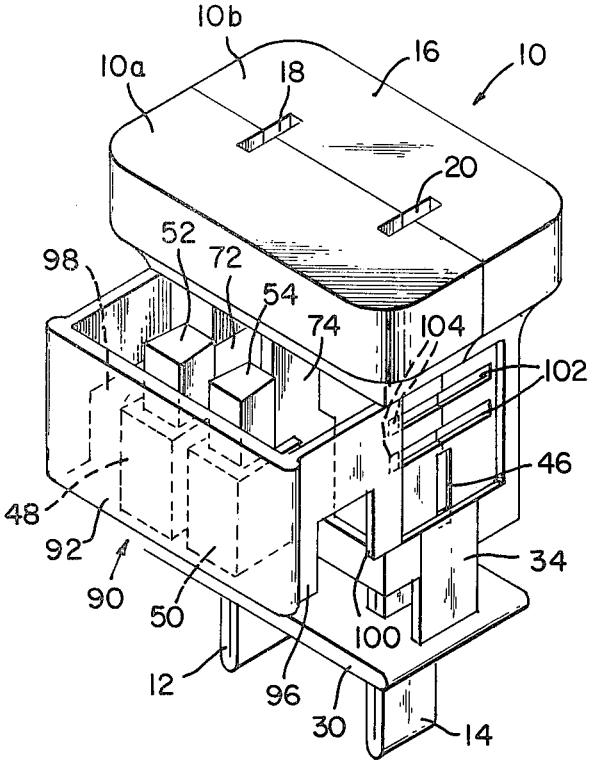
FIG. 10 is an isometric view of a second embodiment of the fused electrical plug showing the access door in its open position.

A second embodiment of the fused electrical plug is illustrated in FIG. 10. The major portion of the plug illustrated in FIG. 10 is identical to the embodiment of FIGS. 1-5 and, therefore, identical numerals are used to designate like structures. The basic difference between the second embodiment illustrated in FIG. 10 and the first embodiment illustrated in FIGS. 1-5 is the use of a pull-out or sliding access door 90 instead of the pivoting access door 22 of FIGS. 1-5. However, both embodiments are alike in that both doors 22,90 are opened by lateral movement of the access covers 28,92, respectively, away from the plug body. The access door 90 includes an access cover 92 extending between two side walls 94,96 each of which include a slot 98,100 for receiving the retaining fingers 32, 34, respectively, projecting rearwardly from the locking plate 30 when the access door is in its closed position. The sides of the plug body 10 contain a pair of parallel slots 102 which receive inwardly projecting tabs 104 on the side walls 94,96 which guide the sliding movement of the access door 90 between the open and closed position. As with the access door 22 of FIG. 15, the access door 90 includes a pair of fuse holders 48,50 projecting inwardly from the access cover 92 so that the fuses 52,54 are placed in the fuse recesses 72,74, respectively, when the access door 90 slides from its open to its closed position. The locking plate 70 is then moved rearwardly thereby inserting the retaining fingers 32,34 in the slots 98,100, respectively, so that it is not possible to open the access door 90 when the prongs 12,14 of the plug are inserted in a socket.

Figure 11:
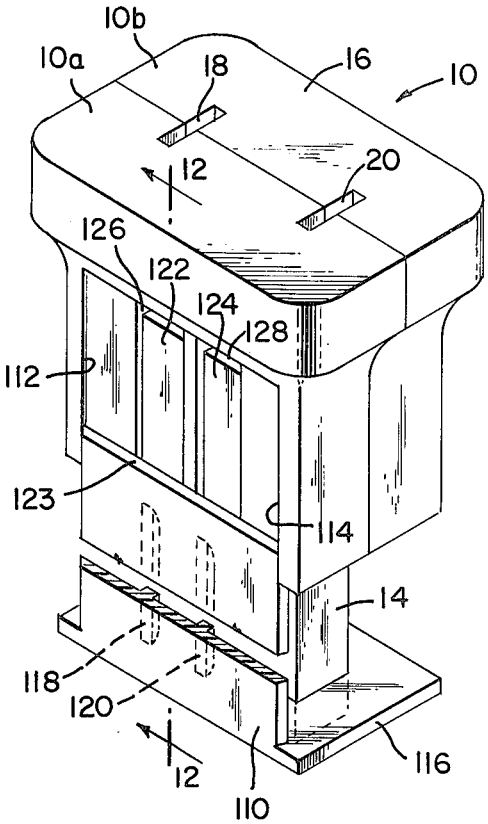
FIG. 11 is an isometric view of a third embodiment of the fused electrical plug showing the access door in its open position.
Figure 12:
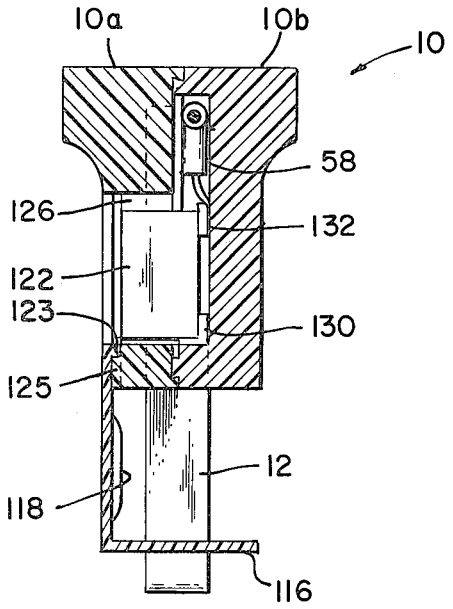
FIG. 12 is a cross-sectional view taken along the line 12—12 of FIG. 11.

A third embodiment of the fused electrical plug as illustrated in FIGS. 11 and 12 is basically identical to the first and second embodiments, except that the access door structure has been modified, fuse holders are not utilized so that the fuses are inserted directly into the fuse recesses, and the fuse contacts 130,132 have been modified. The access door of the third embodiment includes a cover 110 having its longitudinal edges received by slots 112,114 extending along opposite longitudinal edges of a lateral face of the plug body 10 so that the access cover 110 can slide forwardly and rearwardly. A locking plate 116 which may be integrally formed as a flange on the access cover 110 is inserted over the prongs 12,14. The inside face of the access cover 110 includes a pair of projections 118-120 extending toward the fuse recesses 126,128. The inside face of the access cover 110 also includes a transverse projection 123 extending along the rear transverse edge. This projection 123 abuts a projection 124 extending outwardly from the plug body 10*a* between and forward the fuse recesses 126,128 in order to terminate forward movement of the access cover 110 with respect to the plug body 10 thereby preventing the access cover 110 and locking plate 116 from being removed from the plug body 10.

As best illustrated in FIG. 12, the prong 12 has a contact plate 130 with horizontal and vertical legs while a contact member 132 secured to the end of the conductor 58 lies along the inside wall of the fuse recess. As explained hereinafter, the fuses which may be used in the fused plug have contact members which extend along a lateral face of the fuse as well as both ends of the fuse. Thus the fuses may be used with the lateral contacts of the first and second embodiments or the longitudinal contacts of the third embodiment.

In operation the access cover 110 and locking plate 116 are moved forwardly to allow insertion of the fuses 122,124 in the fuse recesses 126,128, respectively. The fuse recesses 126,128 are preferably non-symmetrical to correspond to the non-symmetrical shape of the fuses 122,124 thereby preventing incorrect insertion of the fuses 122,124. The access cover 110 and locking plate 116 are then moved rearwardly so that the access cover 110 prevents access to the fuses 122,124, and the projections 118,120 bias the fuses 122,124 against the contacts 130,132. If desired, the access cover 110 may be transparent so that the fuses are externally visible when the access door is closed in order to determine which, if any, fuse has blown while the plug remains in a socket.

A variety of fuses which may be used with the fused plug are illustrated in FIGS. 6–9. The embodiment illustrated in FIG. 6 includes a fuse body 140 having the overall shape of a prismatoid which is defined as a polyhedron having for bases two polygons in parallel planes, and for lateral faces triangles or trapezoids with one side lying in one base, and the opposite vertex or side lying in the other base, of the polyhedron. The fuse body 140 includes an elongated aperture 142 extending between first and second bases 144,146, respectively. A longitudinal slit 148 is formed in the second base which extends from one end of the fuse body to the other. The opposite ends of the longitudinal slit 148 each terminate in a lateral slit, 150,152 extending from one lateral face 154 to the other 156. A fuse wire 158 is placed within the longitudinal slit 148 and its ends are wrapped around the first base 140 and the lateral slits 150,152. The fuse is then inserted into the fuse recesses 126,128 of the third embodiment with the first base 144 facing inwardly so that the wrapped portions of the fuse wire 158 abut the contacts 130,132. The condition of the fuse wire 158 can then be viewed through the aperture 142.

The fuse embodiment illustrated in FIG. 7 also has the shape of a prismatoid with its second base 160 recessed between opposed lateral faces 162,164 to form a generally U-shaped fuse body. A flat, elongated fuse link 166 extends along the length of the second base 160 with the ends of the fuse link 166 extending around opposite ends of the fuse body to cover the ends of the first base 168. Since the fuse link 166 extends along both the ends and the first base of the fuse body, this embodiment can be utilized with any embodiment of the fused plugs. Since the entire length of the fuse link 166 along the second base 160 is externally visible, opened fuse links are readily detected.

The embodiment illustrated in FIG. 8 includes a fuse body 170 having an elongated aperture 172 extending between first and second bases 174,176, respectively. One lateral face 178 of the fuse body 170 contains a longitudinal slit 180 extending along the length of the fuse body 170. The slit 180 receives a flat, elongated fuse element 182 which projects beyond the ends of the fuse body 170 to cover the ends of the first base 174. This embodiment may also be used with any embodiment of the fused plugs disclosed herein.

The embodiment illustrated in FIG. 9 is essentially identical to the embodiment of FIG. 8 except that the fuse body 190 is of a transparent material eliminating the need for the aperture 172 (FIG. 8) to view the fuse link 192.

The inventive fused plug thus allows their internal fuses to be readily accessible, but insures that the fuses are inaccessible when the plugs are inserted in a socket.

I claim:

1. In a fused electrical plug having a plug body formed with a pair of fuse recesses, a pair of electrical conductors entering said body and terminating in respective contact members in said fuse recesses, a pair of parallel conductor prongs projecting through the forward end of said plug body for insertion into a socket, a pair of removable electrical fuses positioned in said fuse recesses and connecting each of said contact members to a respective said conductor prong, the improvement comprising access door means on the plug body movable independently of said fuses between an open position allowing said fuses to be removed from said recesses and a closed position preventing access to said fuses, access door securing means including a locking plate having a pair of prong receiving slots allowing said plate to slide along said prongs to a locking position wherein said plate abuts the forward end of said plug body, and access door locking means operatively associated with said locking plate for maintaining said access door in its closed position when said locking plate is in its locking position, thereby preventing access to said fuses when said prongs are inserted in said socket.

2. The fused electrical plug of claim 1 wherein each of said fuses comprises an insulated fuse body having the shape of a prismatoid with first and second bases, and a fuse link extending the length of said fuse body and having its ends overlying the first base of said fuse body as coplanar contact portions such that when said fuse body is inserted in said fuse recess with said first base facing inwardly said contact portions engage said contact members and prong.

3. The fused electrical plug of claim 1 wherein said access door includes an access cover covering said fuse recess and a pair of side walls extending from said access cover along opposite sides of said plug body, said access door being opened by lateral movement of said access cover away from said plug body, and wherein said locking means comprise a pair of retaining fingers extending rearwardly from opposite sides of said locking plate and received by respective longitudinal slots extending rearwardly from the forward edge of each side wall when said locking plate is in its closed position thereby preventing lateral movement of said side walls and locking said access cover over said fuse recesses.

4. The fused electrical plug of claim 3 wherein said access door is opened by pivoting said access cover outwardly away from said plug body about a transverse edge of said access cover.

5. The fused electrical plug of claim 4 where each of said retaining fingers further include a tab projecting inwardly towards said body and received by respective longitudinal slots in the sides of said body for guiding said locking plate during sliding movement along said prongs and for preventing removal of said locking plate from said body.

6. The fused electrical plug of claim 3 wherein said access door is opened by linear lateral movement of said access cover away from said fuse recesses with the side walls of said access door sliding along said opposite sides of said plug body.

7. The fused electrical plug of claim 6 wherein each of said retaining fingers further include a tab projecting inwardly toward said body and received by respective longitudinal slots in the sides of said body for guiding said locking plate during sliding movement along said prongs and for preventing removal of said locking plate from said plug body.

8. The fuse electrical plug of claim 6 wherein each side wall of said access door includes a pair of tabs projecting inwardly towards said body and received by respective lateral slots in the sides of said body for guiding the side walls of said access door during sliding movement along the sides of said plug body and for preventing removal of said locking plate from said plug body.

9. The fused electrical plug of claim 1 wherein said access door includes an access cover having its longitudinal edges received by a pair of longitudinal slots in said plug body facing toward each other on opposite sides of said fuse recesses such that said access door may be opened by sliding said access cover forwardly along said slots, and wherein said locking plate extends along the forward edge of said access cover to lock said access door in its closed position when said locking plate is in its locking position.

10. The fused electrical plug of claim 9 wherein the forward edge of said access cover is secured to a transverse edge of said locking plate such that said access cover and locking plate are formed by a single member.

11. The fused electrical plug of claim 9 wherein the inside face of said access cover further includes a projection extending into each fuse recess when said access cover is in its closed position for urging said fuses into contact with their respective contact members and conductor prongs.

12. The fused electrical plug of claim 9 wherein the inside face of said access cover further includes a transverse projection extending along the rear transverse edge of said access cover and wherein said plug body includes an outwardly facing projection between and forward of said fuse recesses thereby terminating forward sliding movement of said access cover along said plug body when the projection on said access cover contacts the projection on said plug body.

13. The fused electrical plug of claim 8 wherein said contact members extend along the longitudinal wall facing said access cover at the rear end of each fuse recess, and said prongs include a prong contact member extending along said longitudinal wall at the forward end thereof such that a fuse having fuse contacts on a lateral face may be inserted into said fuse recess and abut said contact member and said prong contact member.

14. The fused electrical plug of claim 2 further including a fuse holder projecting into each of said fuse recesses from said access cover when said access door is in its closed position, said fuses being carried by said fuse holders such that said fuses are inserted into said fuse recesses by closing said access door, and said fuses are removed from said fuse recesses by opening said access door.

15. The fused electrical plug of claim 14 wherein each of said fuse holders includes a tubular member adapted to receive said fuse and a tab projecting inwardly from one end of said tubular member to abut one end of said fuse to restrict axial movement of said fuse in said tubular member.

16. The fused electrical plug of claim 14 wherein said fuses have non-symmetrical shapes and said fuse holders include a fuse receiving bore having a shape corresponding to the shape of said fuses thereby limiting the orientations with which said fuses can be inserted into said fuse holders.

17. In a fusable electrical plug, a plug body having an end wall and a side wall adjoining the end wall, said plug body being formed with a fuse recess for receiving a fuse and said side wall having an access opening therein to said fuse recess, an electrical conductor terminating at a respective contact member at one end portion of the fuse recess, a conductor prong projecting through said end wall for insertion into a socket and having a respective contact member at an opposite end portion of the fuse recess, a slide door cooperating with the plug body to be moved outwardly from a closed position covering the access opening to an open position providing access to the fuse recess so that a fuse can be inserted or removed, and a slide flange secured at the outer end of the slide door having a sliding engagement with said prong and being arranged to seat against said end wall when the slide door is in closed position.

18. In a fusable electrical plug according to claim 17, a guide slot in said flange engaging opposite portions of said prong.

19. In a fusable electrical plug according to claim 17, a guide hole in said flange for said prong.

20. In a fusable electrical plug according to claim 17, a second conductor prong projecting through said end wall in parallel spaced relation to the first-mentioned prong, said guide flange fitting between both said prongs.

21. In a fusable electrical plug according to claim 20, said guide flange being slotted at opposite edge portions to interfit with both said prongs.

22. In a fusable electrical plug according to claim 20, said guide flange having a pair of openings to interfit with both said prongs.

23. In a fusable electrical lug according to claim 17, said slide door having a sliding interfit with said side wall at opposite edges of the access opening, and said flange having a sliding interfit with said prong.

24. In a fusable electrical plug according to claim 23, the inner end of said slide door having a projecting stop opposite from said flange and arranged to engage the plug body when the slide door is in open position.

25. In a fusable electrical plug according to claim 17, said plug body being formed with a socket for receiving the conductor prong of another plug such as to engage the first mentioned conductor prong within the plug body in spaced relation to said fuse recess.

26. In a fusable electrical plug according to claim 23, said slide cover having a lug extending toward the fuse recess for pressing against a fuse in the fuse recess when the slide cover is in closed position.

27. A fusable plug comprising:

a plug body having front and rear end faces interconnected by side faces and formed with a pair of longitudinal side-by-side fuse recesses, one of said side faces having an access opening to said fuse recesses, a pair of electrical conductors entering said body and terminating in respective contact members at the rear end portion of said fuse recesses, a pair of parallel conductor prongs projecting through the front end of said body for insertion into a socket and presenting respective contact members at the front end portion of said fuse recesses, a pair of fuses seated in said fuse recesses and connecting respective of the conductor contact members to respective of the prong contact members, said fuses being adapted to pass through said fuse access opening, a slide door interfitting with the plug body to cover said access opening when in a closed position and to give access to said fuses when in an open position, and a slide flange at the rear end of the slide door projecting between said prongs, said side flange being arranged to engage the front end of the plug body when the slide door is in closed position.

28. A fusable electrical plug according to claim 27 in which said flange slidingly interfits with said prongs.

29. A fusable electrical plug according to claim 28 in which said slide cover has a stop arranged to engage said plug body at the front end of said access opening when the slide door is in open position.

30. A fusable electrical plug according to claim 27 in which the rear end of the plug body has a pair of sockets located at opposite sides of said fuse recesses in spaced relation thereto and exposed to said prongs for receiving a pair of prongs of another plug.

31. A fused electrical plug comprising:

a plug housing having therein a laterally spaced outer pair of longitudinal prong recesses and a central separated adjacent pair of longitudinal fuse recesses positioned side-by-side directly between and adjacent to said prong recesses, said fuse recesses each having a respective access opening located at one face of said housing, said housing having a slide cover at said one face of the housing for closing said access openings when the cover is in closed poistion, a pair of longitudinal conducting prongs in said prong recesses and projecting in parallel laterally spaced relation from an end face of said housing different from said one face, each of said prongs having a prong contact projecting into the adjoining fuse recess at the end thereof adjacent said end face of the housing, a pair of elongated fuses with contacts at their opposite ends located in said fuse recesses and adapted to pass through said access openings when said cover is in open position, the fuse contacts at one end of the fuses engaging respective of said prong contacts, a pair of conductor leads passing side-by-side externally through said housing adjacent the other ends of said fuse recesses which are located remote from said end face of the housing, said conductor leads having respective conductor contacts positioned in the fuse recesses at said other ends and arranged to be engaged by respective of the fuse contacts at the other end of the fuses, means for holding the fuse contacts in operative engagement with the prong contacts and the conductor contacts, and a flange on the slide cover interfitting with said prongs and engaging the plug housing when the cover is in closed position.

32. A fusable electrical plug according to claim 31 in which said means for holding the fuse contacts in operative engagement with the prong contacts and the conductor contacts comprises a portion of said cover located at said access openings of the fuse recesses.

33. In a fusable electrical plug, a plug body having an end wall and a side wall adjoining the end wall, said plug body being formed with a fuse recess for receiving a fuse and said wall having an access opening therein to said fuse recess, an electrical conductor terminating at a respective contact member at one end portion of the fuse recess, a conductor prong projecting through said end wall for insertion into a socket and having a respective contact member at an opposite end portion of the fuse recess, a slide door slidably interfitting with the plug body to be moved outwardly from a closed position covering the access opening to an open position providing access to the fuse recess so that a fuse can be inserted or removed, and means on the slide door for maintaining the interfit with the plug body when the slide door is in its open position.

34. A fused plug comprising:

a plug body having front and rear end faces interconnected by side faces and formed with a pair of separated longitudinal side-by-side fuse recesses each having a closed bottom face, one of said side faces having an access opening to said fuse recesses opposite from the bottom face thereof, a pair of electrical conductor means in said body having respective exposed terminal portions at the rear end portion of said fuse recesses which are seated against the bottom thereof, a pair of parallel conductor prongs projecting through the front end of said body for insertion into a socket and presenting respective exposed contact members at the front end portion of said fuse recesses which are seated against the bottom thereof, a pair of fuses in said fuse recesses and having respective elongated fuse links with coplanar contact portions facing toward the bottom of the fuse recesses and arranged to engage and connect respective of said terminal portions to respective of the prong contact members, said fuses being adapted to pass through said fuse access opening, and door means on the plug body for covering said access opening when in a closed position and for giving access to said fuses when in an open position, said door means engaging said fuses when in its closed position to hold the contact portions of the fuse link of each fuse in engagement with the underlying terminal portions of the conductor members and the prong contact members.

35. A fused plug according to claim 34 in which said door means is movable between said positions independently of said fuses.

36. A fused plug according to claim 35 in which said door means has a sliding interfit with the plug body and has inwardly projecting portions engaging the top of the fuses when the door is in its closed position.

37. A fused plug according to claim 34 in which each of said fuse links comprises a thin strip of conductive material and has its said contact portions coplanar.

38. A fused plug according to claim 34 in which said fuses each comprise a fuse body having the general shape of an elongated prismatoid with top and bottom elongated bases, each said fuse link being of thin electrically conductive strip material having its opposite end portions secured flat against opposite end portions of the bottom base of the respective fuse body to engage said conductor and prong contact members, said door means engaging said top bases of said fuses when the door is in its closed position.

* * * * *